US005593298A

United States Patent [19]

Hurley et al.

[11] Patent Number: 5,593,298

[45] Date of Patent: Jan. 14, 1997

[54] POLLUTANT REDUCING MODIFICATION OF A TANGENTIALLY FIRED FURNACE

[75] Inventors: John F. Hurley, Easton; Edward O. Hartel, Orange, both of Conn.

[73] Assignee: Combustion Components Associates, Inc., Monroe, Conn.

[21] Appl. No.: 419,366

[22] Filed: Apr. 10, 1995

[51] Int. Cl.[6] ..... F23M 3/00

[52] U.S. Cl. ..... 431/9; 431/178; 110/763; 110/764; 110/265

[58] Field of Search ..... 431/9, 175, 176, 431/177, 178; 110/261, 263–265

[56] References Cited

U.S. PATENT DOCUMENTS

| | | | |
|---|---|---|---|
| 2,608,168 | 8/1952 | Jackson | 431/176 |
| 3,256,842 | 6/1966 | Vigneron et al. | 110/261 |
| 4,304,196 | 12/1981 | Chadshay et al. | 110/261 |
| 4,570,551 | 2/1986 | Derbidge et al. | 110/263 |

*Primary Examiner*—Carroll B. Dority
*Attorney, Agent, or Firm*—Peter Kent

[57] ABSTRACT

For reducing pollutant generation in a tangentially fired furnace, a method and apparatus for modification of a main air-fuel compartment. An extender dish for mounting on the discharge face of the compartment has a wide projection to extend across the discharge face half portion closer to the axis of the fireball in the furnace firing chamber and a narrow projection to extend across the discharge face half portion further from the fireball axis. Preferably a flow restricting plate is also provided to extend across a part of the discharge face portion closer to the axis of the fireball. These air restricting means cause a portion of the combustion air from the main air-fuel compartment discharge face to be directed outside the fireball therein reducing oxygen concentration and flame temperature thereby lowering pollutant generation. Working in concert with auxiliary air compartments, this method and apparatus are most efficient in pollutant reduction at low furnace loads where most pollution reduction is required.

26 Claims, 4 Drawing Sheets

POLLUTANT REDUCING MODIFICATION OF A TANGENTIALLY FIRED FURNACE

BACKGROUND

Figure 1:
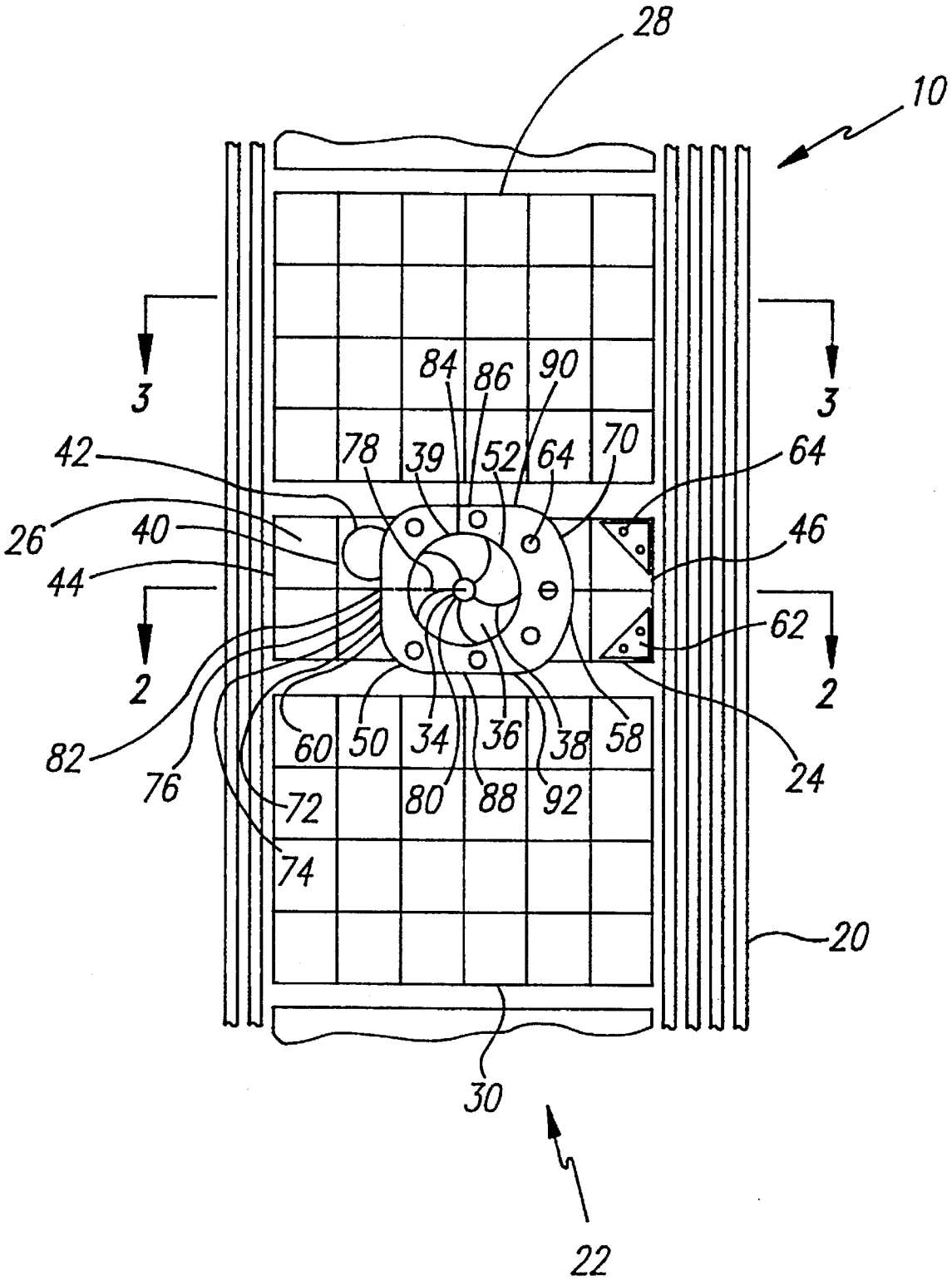

This invention relates to a tangentially fired furnace, more specifically to a modification of a tangentially fired furnace to reduce pollutant generation.

The Clean Air Act and the Amendments of 1990 have imposed increasingly stringent controls on the industrial generation of pollutants such as NO and $NO_2$ (NOX) and $SO_2$ and $SO_3$ (SOX). These pollutants are emitted in large quantities from combustion operations carried out in electric utility and other industrial furnaces. To reduce the formation of these pollutants, methods and apparatus have been developed.

In the oxidant predilution method, oxygen concentration in the combustion air supply is reduced by mixing in a quantity of inert gas. Commonly used diluents are nitrogen from an external source or furnace flue gas in which oxygen has been depleted. From 5% to 20% flue gas recirculation or nitrogen is commonly introduced into the air supplied to the furnace windbox for combustion of fuel. The diluent lowers the peak flame temperature in the primary fuel burning zone, which reduces the generation of pollutants.

In the "overfire air" method, the quantity of combustion air supplied in close proximity to the fuel introduction location in the furnace firing chamber is reduced relative to prior practice. This causes a reduction in the concentration of oxygen at the primary burning location and lowered flame temperature, resulting in reduced pollutant generation. Special air supply ports are installed above the fuel introduction locations to make up the deficit in air required for complete combustion of the fuel introduced. This air is called overfire air.

These known methods and the apparatus required to practice them are sophisticated, mechanically complex, and costly. What is needed is a method and apparatus for inexpensively modifying a tangentially fired furnace to accomplish pollutant reduction.

SUMMARY

This invention satisfies the above needs. This invention is directed to a tangentially fired furnace comprising a firing chamber having at least four corners and a vertical axis providing a central location for a fireball. The firing chamber has at least four columns, each located in a respective corner of the firing chamber. In each of the columns is at least one main air-fuel compartment having a discharge face for discharging fuel and air flows oriented to a given side of the firing chamber axis. Because of this orientation, a discharge face has a half portion further from the axis and a half portion closer to the axis. Centrally positioned in the discharge face is a fuel nozzle and a surrounding air passage for discharging a fuel stream and a surrounding air stream. Extending across part of the compartment discharge face half portion closer to the axis is air flow restricting means capable of directing from about 5% to about 20% of air required for complete combustion of the fuel from the discharge face on a path outside of a fireball around the axis in the firing chamber.

A preferred version of the air stream restricting means comprises an extender dish mounted centrally on and flaring away from the compartment discharge face. The extender dish has a central opening for a fuel stream and surrounding air stream from the fuel nozzle and surrounding air passage, a narrow projection across the discharge face half portion further from the axis and a wide projection across the discharge face half portion closer to the axis. The air stream restricting means may further comprise at least one plate partially extending across the compartment discharge face half portion closer to the axis. The air stream restriction means may close off for flow from about 10% to about 50% of the area of the compartment discharge face half portion located closer to the axis.

DRAWINGS

Figure 2:
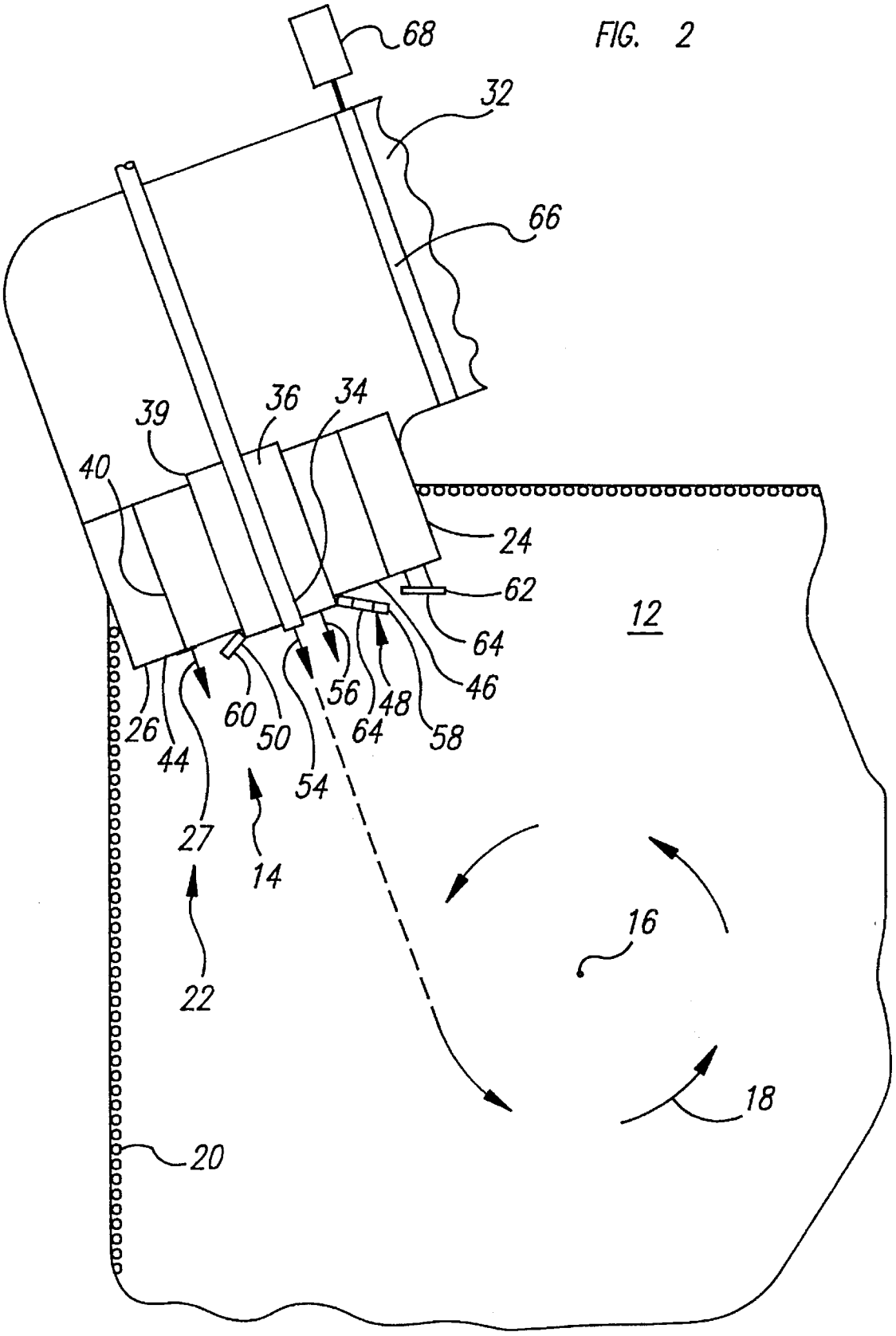
Figure 3:
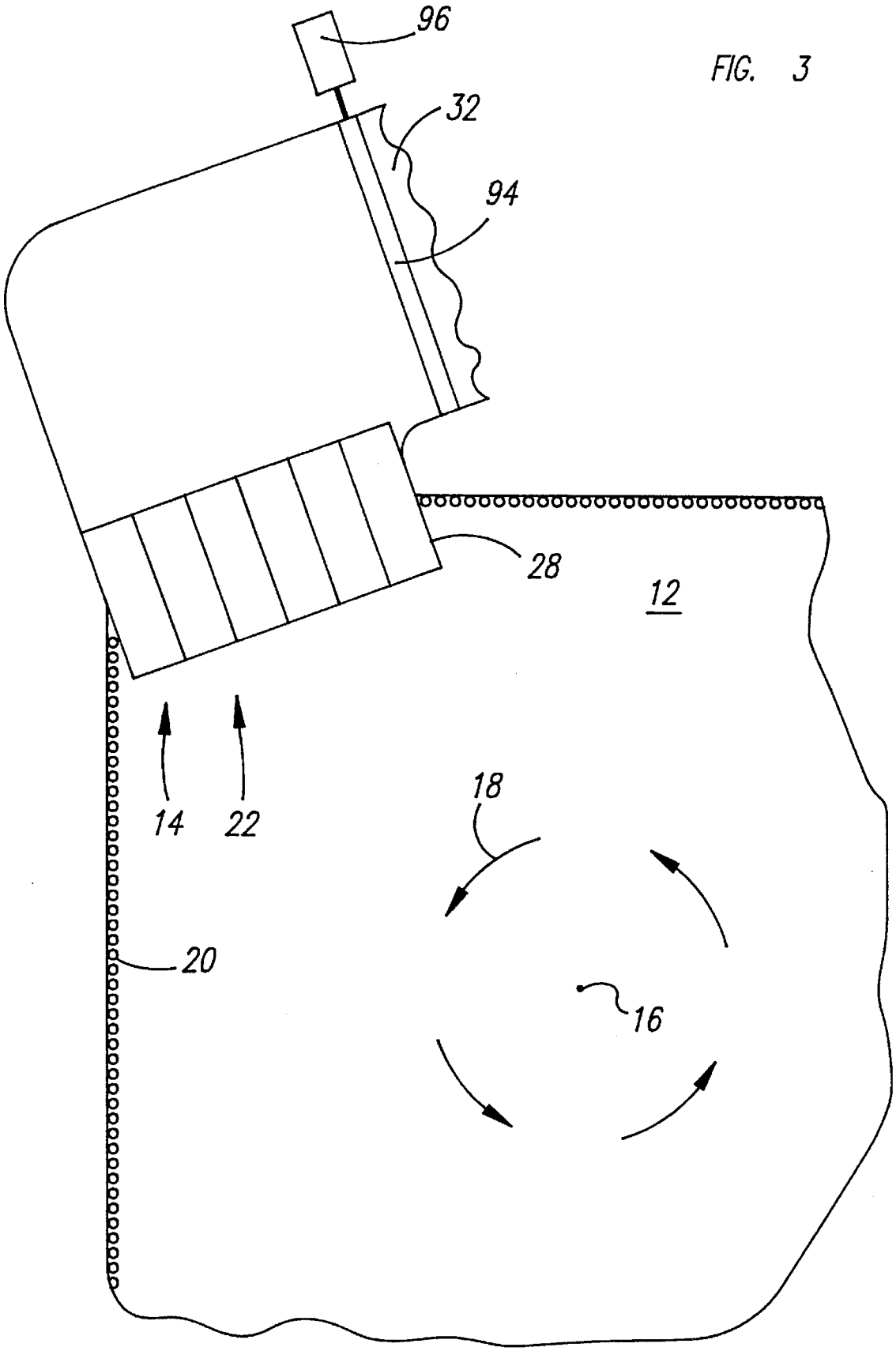
Figure 4:
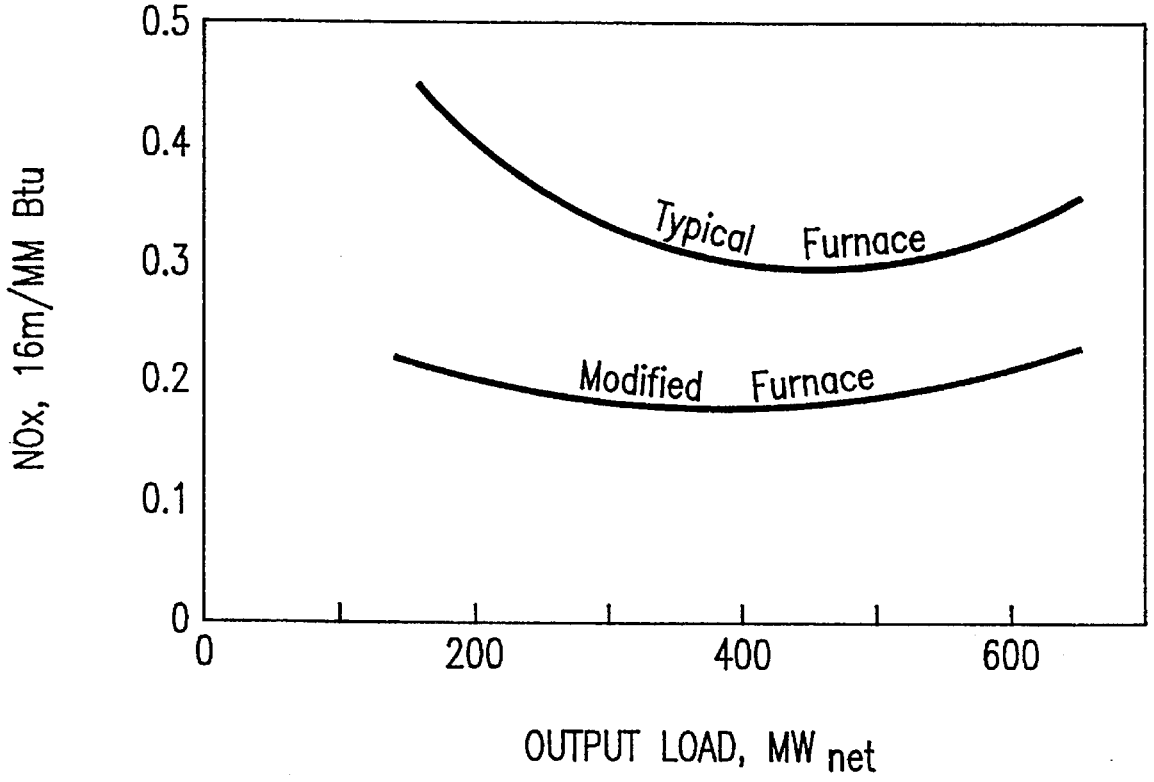

These and other features, aspects and advantages of the present invention will become better understood with reference to the following description, appended claims, and accompanying drawings where FIG. 1 is a elevational view of a corner portion of a tangentially fired furnace embodying the invention;

FIG. 2 is a cross-sectional plan view at line 2—2 of the corner portion of the tangentially fired furnace in FIG. 2, which is a view through a main air-fuel compartment;

FIG. 3 is a cross-sectional plan view at line 3—3 of the corner portion of the tangentially fired furnace in FIG. 3, which is a view through an auxiliary air compartment; and FIG. 4 is a graphical comparison of NOX emission as a function of load or fuel flow for a typical tangentially fired furnace and the furnace as modified by embodying the present invention. Emission is expressed as pounds of NOX generated per million BTU of gross heat input as a function of net output load in megawatts.

DESCRIPTION

With reference to the drawings, a tangentially fired furnace 10 has a firing chamber 12 typically having at least four corners 14 and a vertical axis 16 providing a central location for a fireball 18. The fireball is the most intense or primary combustion zone. Thus there are portions of the firing chamber which are within the fireball and portions which are outside the fireball. Much of the perimeter of a firing chamber 12 is occupied by tubes 20 receiving heat from the combustion process carried out in the firing chamber. In a corner of the firing chamber is located a column 22 containing various compartments serving particular functions. Compartments may be provided at several levels to combust liquid oil, natural gas or pulverized fuel, such as coke, coal or peat. Each column 22 contains at least one main air-fuel compartment 24 having a discharge face 26 for discharging air flow 27 and fuel flow 54. Typically an auxiliary air compartment 28 above and an auxiliary air compartment 30 below each main air-fuel compartment 24 are provided to emit air flows to supply auxiliary air for combustion of the fuel from each main air-fuel compartment. To compartments 24, 28, 30 in a given corner, a supply of air is provided from a common windbox 32.

A main air-fuel compartment 24 in its discharge face 26 typically has a centrally positioned fuel nozzle 34 and an air passage 36 surrounding the fuel nozzle. Optionally, vanes 38 are provided in the air passage 36 to swirl the air stream 56 from the passage 36 around the fuel stream 54 discharging from the fuel nozzle. The vanes 38 may be shrouded by a cylinder 39. Within the main air-fuel compartment 24 usually also are reinforcing plates 40 or struts which form cells through which air flows and discharges. Typically at least one scanner 42, which substantially occupies a cell, is provided for observing the presence and quality of flame resulting from combustion of fuel emanating from the main air-fuel compartment.

All of the main air-fuel compartments 24 in the several columns 22 are similarly oriented to the same given side of the firing chamber axis 16 so that a rotating fireball 18 is created in the firing chamber 12. Because of the orientation of a main air-fuel compartment 24 relative to the firing chamber axis 16, the discharge face 26 of a main air-fuel compartment 24 has a half portion 44 further from the firing chamber axis 16 and a half portion 46 closer to the axis.

Across part of the main air-fuel compartment discharge face half portion 46 which is closer to the axis of the firing chamber is an air flow restricting means 48 which restricts airflow from that half portion 46. Consequently, with less of the air flow from that compartment 24 being directed into the fireball 18, that is, into the primary burning location, the primary combustion location has reduced concentration of air for the formation of NOX and SOX, which reduces the formation of these pollutants. The reduced concentration of air also results in lower flame temperature in the primary combustion location, which in itself also serves to reduce the formation of NOX and SOX. Compensatively, a larger fraction of the total air for combustion of the fuel is supplied from the discharge face half portion 44 further from the firing chamber axis, and therefore directed outside the fireball 18. Thus the effects of restricting the air flow from the discharge face half portion 46 which is closer to the axis of the firing chamber are to reduce oxygen concentration and temperature in the primary combustion location and to spread out the combustion over both space and time, which serve to reduce the formation of pollutants.

To increase recirculation of the combustion products, enhance combustion, and promote combustion product burn out, an extender dish 50 may be mounted on a main air-fuel compartment discharge face 26 flaring radially outwardly and away from the main air-fuel compartment discharge face. The extender dish 50 has a central opening 52 for the fuel nozzle 34 and the surrounding shroud cylinder 39 which may project somewhat from the compartment discharge face 26. Optionally the fuel nozzle 34 and surrounding shroud cylinder 39 may not project from the compartment discharge face 26. Then the central opening 52 serves as a passage for a fuel stream 54 from the fuel nozzle 34 and air stream 56 from the air passage 36. Optionally the vanes 38 may be omitted and replaced with struts to space the fuel nozzle 34 in the surrounding cylinder 39. Optionally the cylinder 39 may be omitted and the fuel nozzle supported from the compartment structure.

The extender dish 50 may serve as an air flow restricting means 48 on the discharge face half portion 46 closer to the firing chamber axis by providing a wide projection 58 across the discharge face half portion 46 closer to the axis and a narrow projection 60 across the discharge face half portion 44 further from the axis. An extender dish 50 may be fabricated from a dish initially having an approximately circular periphery 70 and a central opening 52, which is preferably circular. From a first portion 72 of the dish, a first segment 74 is removed. The first removed segment 74 lies outside a first chord 76 normal to a line segment 78 from the central opening center 80 to a point 82 short of the dish periphery 70. Preferably the first chord 76 lies at a distance from the central opening periphery 84 of about zero to about 0.6 times the distance from the dish periphery 70 to the central opening periphery 84, as measured along a line 78 from the center 80 of the central opening normal to the first chord 76.

The first portion 72 of the dish is intended for extension across a main air-fuel compartment discharge face half portion 44 located further from the axis of a firing chamber providing a central location for a fireball. This first portion 72 of the dish when installed on a main air-fuel compartment provides the narrow projection 60 across the discharge face half portion further from the axis of the firing chamber, and the portion of the dish diametrically opposite provides the wide projection 58 across the discharge face half portion 46 closer to axis of the firing chamber.

To achieve good combustion characteristics and to control steam temperatures, it is desirable at times to direct the air and fuel flows from a main air-fuel compartment somewhat upwards or downwards, as by tilting a main air-fuel compartment upwards or downwards. To allow such tilting of a main air-fuel compartment without geometric interference from a vertically adjacent compartment, such as an auxiliary air compartment, an extender dish may have cut away from it a second segment 86 and a third segment 88. The second segment 86 is removed outside a second chord 90 normal to the first chord 76, the second chord 86 lying above the central opening periphery 84 and under the dish periphery 70. The third segment 88 is removed outside a third chord 92 normal to the first chord 76, the third chord lying below the central opening periphery 84 and above the dish periphery 70. The segments removed are just large enough to provide sufficient clearance for tilting of the compartment.

The air flow restricting means 48 may further comprise at least one restricting plate 62, and preferably at least two restricting plates, partially extending across the compartment discharge face half portion 46 closer to the axis. Preferably a restricting plate has the shape of a right triangle. To reduce the operating temperature of an extender dish 50 and the restricting plates 62, holes 64 may be provided in these elements to permit throughflow of air with resulting cooling. To accommodate such cooling holes, the periphery of an extender dish may deviate from circularity, or deviate from straightness along a removed segment. It is apparent that provision of such an extender dish and restricting plates is inexpensive, and provides an inexpensive method of readily retrofitting an existing furnace for decreased NOX and SOX production.

The air flow restricting means may restrict or close off for flow from about 10% to about 50% of the area of a main air-fuel compartment discharge face half portion closer to the axis of a firing chamber. Such an air flow restricting means can direct from about 5% to about 20% of air required for complete combustion of fuel from a main air-fuel compartment on a path outside of a fireball in a furnace firing chamber.

Between each main air-fuel compartment 24 and the windbox 32 which supplies air to the compartment is a damper 66 and a control 68 which adjusts the damper 66 to maintain airflow discharge from the compartment proportionate to furnace load, or equivalently, to fuel flow from the compartment. Between each auxiliary air compartment 28, 30 and the windbox 32 which supplies air to the compartment is a damper 94 and a control 96 which adjusts the damper 94 to maintain a constant pressure differential from the windbox 32 to the furnace firing chamber 12. Thus at low fuel flows an auxiliary air compartment damper 94 tends to close toward greater restriction of air flow through an auxiliary air compartment 28, 30 and allows a main air-fuel compartment 24 to supply at low fuel flows a greater fraction of total combustion air than at high fuel flows. At high loads the respective dampers open such that auxiliary air compartments may supply up to three times as much combustion air as main air-fuel compartments. At very low loads or fuel flows, auxiliary air compartment dampers can be completely closed allowing all combustion air to be supplied by main air-fuel compartments. Thus at low loads or low fuel flows, this invention causes a main air-fuel compartment discharge face half portion further from a firing chamber axis to discharge a larger fraction of total combustion air outside of a fireball in a furnace chamber than at high loads or high fuel flows. Hence this invention is most effective and beneficial during furnace operation at low loads when pollutant concentration generation is higher.

FIG. 4 provides a comparison of NOX emission by a typical tangentially fired furnace and a tangentially fired furnace modified pursuant to this invention. Use of the invention achieves a relative pollutant reduction of 35% at high load, 39% at mid load, and 48% at low load. Use of the invention causes the emission characteristic with load to be flatter and relatively more reduced at low load where greater reduction is needed.

Although certain preferred embodiments of the present invention have been described, the spirit and scope of the invention is by no means restricted to what is described above. For example, the means for restricting a main air-fuel compartment discharge face half portion may comprise other geometric configurations than those specifically described.

What is claimed is:

1. A tangentially fired furnace with lowered NOX/SOX emissions, said furnace comprising:

(a) a firing chamber having at least four corners and a vertical axis for providing a central location for a fireball;

(b) at least four columns each located in a respective corner of said firing chamber;

(c) at least one main air-fuel compartment in each of said columns, said at least one compartment having a discharge face for discharging fuel and air flows oriented to a given side of said axis, whereby said discharge face has a half portion further from said axis and a half portion closer to said axis;

(d) a fuel nozzle centrally positioned in said discharge face for discharging a fuel stream;

(e) an air passage surrounding said fuel nozzle for discharging an air stream surrounding a fuel stream from said nozzle; and (f) air flow restricting means across part of said compartment discharge face half portion closer to said axis which restricts air flow from said compartment discharge face half portion closer to said axis so that less air flow from said compartment is directed into said central location for a fireball and a larger fraction of the total air for combustion of the fuel is supplied from said discharge face half portion further from said axis and therefore directed outside said central location for a fireball.

2. The furnace as in claim 1 wherein said air flow restricting means is capable of directing from about 5% to about 20% of air required for complete combustion of fuel from said discharge face on a path outside of a fireball around said axis in said furnace firing chamber.

3. The furnace as in claim 1 wherein said air flow restricting means comprises an extender dish mounted centrally on and flaring away from said compartment discharge face, said extender dish being formed from a piece of material having:

(a) an approximately circular periphery; and (b) a central opening having a periphery and a center; and said piece of material having (c) a first portion with a first segment removed outside a first chord normal to a line segment from said central opening center to a point short of said dish periphery, said first portion extending across said discharge face half portion further from said axis.

4. The furnace as in claim 1 further comprising a windbox for each column for air supply to compartments therein, a damper upstream of said main air-fuel compartment, and a control on said damper to regulate airflow discharge from said main air-fuel compartment proportionate to fuel flow from said main air-fuel compartment, and further comprising at least one auxiliary air compartment vertically adjacent to said at least one main air-fuel compartment, a damper upstream of said auxiliary air compartment, and a control on said damper to regulate airflow discharge from said auxiliary air compartment into said firing chamber to maintain a constant pressure differential from said windbox to said furnace firing chamber, whereby at low fuel flows said main air-fuel compartment in conjunction with said auxiliary air compartment supplies a larger fraction of total combustion air at low fuel flows than at high fuel flows, and thereby at low fuel flows said main air-fuel compartment directs a larger fraction of total combustion air outside of a fireball in said furnace chamber than at high fuel flows.

5. A main air-fuel compartment for lowering NOX/SOX emissions in a tangentially fired furnace having a firing chamber with a vertical axis for providing a central location for a fireball, said compartment having:

(a) a discharge face for discharging fuel and air flows oriented to a given side of a firing chamber axis whereby said discharge face has a half portion for further location from the axis and a half portion for closer location to the axis;

(b) a fuel nozzle centrally positioned in said discharge face to discharge a fuel stream;

(c) an air passage around said fuel nozzle for discharging an air stream around a fuel stream from said nozzle; and (d) air flow restricting means across part of said compartment discharge face half portion for location closer to the axis which restricts air flow from said compartment discharge face half portion closer to the axis so that less air flow from said compartment is directed into said central location for a fireball and a larger fraction of the total air for combustion of the fuel is supplied from said discharge face half portion further from the axis and therefore directed outside said central location for a fireball.

6. The compartment as in claim 5 wherein said air flow restricting means is capable of directing from about 5% to about 20% of air required for complete combustion of fuel from said discharge face on a path outside of a fireball in a tangentially fired furnace firing chamber.

7. The compartment as in claim 5 wherein said air flow restricting means comprises an extender dish mounted centrally on and flaring away from said compartment discharge face, said extender dish being formed from a piece of material having:

(a) an approximately circular periphery; and (b) a central opening having a periphery and a center; and said piece of material having (c) a first portion with a first segment removed outside a first chord normal to a line segment from said central opening center to a point short of said dish periphery, said first portion extending across said discharge face half portion for location further from said axis.

8. The compartment as in claim 7 wherein said first chord is located a distance from said central opening periphery equal to from about zero to about 0.6 times a distance from said dish periphery to said central opening periphery as measured along a line from the center of said central opening normal to said chord.

9. The compartment as in claim 6 wherein said air flow restricting means closes off for flow from about 10% to about 50% by area of said compartment discharge face half portion for location closer to the axis.

10. A method for lowering NOX/SOX emissions in a tangentially fired furnace having a firing chamber with a vertical axis for providing a central location for a fireball, said method comprising:

(a) providing a main air-fuel compartment having a discharge face for air and fuel flow including a centrally positioned fuel nozzle and surrounding air passage;

(b) orienting said discharge face relative to a vertical axis providing a central location for a fireball in a tangentially fired furnace firing chamber whereby said discharge face has a half portion further from the axis and a half portion closer to the axis;

(c) discharging from said discharge face fuel and air flows oriented to a given side of the axis;

(d) restricting for air flow a part of said compartment discharge face half portion located closer to the axis so that less air flow from said compartment is directed into said central location for a fireball and a larger fraction of the total air for combustion of the fuel is supplied from said discharge face half portion further from the axis and therefore directed outside said central location for a fireball.

11. The method as in claim 10 further comprising restricting said compartment discharge face so that from about 5% to about 20% of air required for complete combustion of fuel from said discharge face is directed outside of a fireball in the furnace firing chamber.

12. The method as in claim 10 further comprising discharging from said main air-fuel compartment a larger fraction of total air required for complete combustion of fuel from said main air-fuel compartment at low fuel flows than at high fuel flows, whereby a larger fraction of total air for combustion of fuel from said main air-fuel compartment is directed outside of a fireball in the firing chamber at low fuel flows than at high fuel flows.

13. The method as in claim 10 wherein restricting said compartment discharge face comprises closing off for flow from about 10% to about 50% by area of said compartment discharge face half portion closer to the axis.

14. The method as in claim 10 wherein restricting said compartment discharge face comprises mounting an extender dish centrally on and flaring away from said compartment discharge face, said extender dish being formed from a piece of material having:

(a) an approximately circular periphery; and (b) a central opening having a periphery and a center; and said piece of material having (c) a first portion with a first segment removed outside a first chord normal to a line segment from said central opening center to a point short of said dish periphery, said first portion extending across said discharge face half portion for location further from said axis.

15. An apparatus for lowering NOX/SOX emissions in a tangentially fired furnace enclosing a firing chamber with a vertical axis for providing a central location for a fireball and having at least one main air-fuel compartment with a discharge face for discharging fuel and air flows oriented to a given side of the axis, whereby each discharge face has a half portion further from the axis and a half portion closer to the axis, said apparatus comprising: an extender dish for mounting centrally on and flaring away from a main air-fuel compartment discharge face, said extender dish having a central opening for passage of a fuel stream and surrounding air stream, said extender dish having a narrow projection for extension across a compartment discharge face half portion for location further from a firing chamber vertical axis providing a central location for a fireball and a wide projection for extension across a compartment discharge half portion for location closer to the axis.

16. The apparatus as in claim 15 further comprising at least one flow restricting plate for partial extension across a compartment discharge face, said plate in the shape of a right triangle.

17. The apparatus as in claim 16 further having at least one hole for passage of air flow.

18. A tangentially fired furnace with lowered NOX/SOX emissions, said furnace comprising:

(a) a firing chamber having at least four corners and a vertical axis for providing a central location for a fireball;

(b) at least four columns each located in a respective corner of said firing chamber;

(c) at least one main air-fuel compartment in each of said columns, said at least one compartment having a discharge face for discharging fuel and air flows oriented to a given side of said axis, whereby said discharge face has a half portion further from said axis and a half portion closer to said axis;

(d) a fuel nozzle centrally positioned in said discharge face for discharging a fuel stream;

(e) an air passage surrounding said fuel nozzle for discharging an air stream surrounding a fuel stream from said nozzle; and (f) air flow restricting means across part of said compartment discharge face half portion closer to said axis, said air flow restricting means comprising an extender dish mounted centrally on and flaring away from said compartment discharge face, said extender dish having a central opening for passage of a fuel stream and surrounding air stream from said fuel nozzle and surrounding air passage, said extender dish having a narrow projection across said discharge face half portion further from said axis and a wide projection across said discharge face half portion closer to said axis.

19. The furnace as in claim 18 wherein said air flow restricting means further comprises at least one plate partially extending across said compartment discharge face half portion closer to said axis.

20. The furnace as in claim 19 wherein said flow restricting means has at least one hole for passage of airflow.

21. The furnace as in claim 18 wherein said air flow restricting means closes off for flow from about 10% to about 50% by area of said compartment discharge face half portion closer to said axis.

22. A main air-fuel compartment for lowering NOX/SOX emissions in a tangentially fired furnace having a firing chamber with a vertical axis for providing a central location for a fireball, said compartment having:

(a) a discharge face for discharging fuel and air flows oriented to a given side of a firing chamber axis whereby said discharge face has a half portion for further location from the axis and a half portion for closer location to the axis;

(b) a fuel nozzle centrally positioned in said discharge face to discharge a fuel stream;

(c) an air passage around said fuel nozzle for discharging an air stream around a fuel stream from said nozzle; and (d) air flow restricting means across part of said compartment discharge face half portion for location closer to the axis, said air flow restricting means comprising an extender dish mounted centrally on and flaring away from said compartment discharge face, said extender dish having a central opening for a fuel stream and surrounding air stream from said fuel nozzle and surrounding air passage, said extender dish having a narrow projection across said compartment half portion for location further from the axis and a wide projection across said compartment half portion for location closer to the axis.

23. The compartment as in claim 22 wherein said air flow restricting means further comprises at least one plate partially extending across said compartment discharge face half portion for location closer to the axis.

24. The compartment as in claim 23 wherein said air flow restricting means has at least one hole for passage of airflow.

25. A method for lowering NOX/SOX emissions in a tangentially fired furnace having a firing chamber with a vertical axis for providing a central location for a fireball, said method comprising:

(a) providing a main air-fuel compartment having a discharge face for air and fuel flow including a centrally positioned fuel nozzle and surrounding air passage;

(b) orienting said discharge face relative to a vertical axis providing a central location for a fireball in a tangentially fired furnace firing chamber whereby said discharge face has a half portion further from the axis and a half portion closer to the axis;

(c) discharging from said discharge face fuel and air flows oriented to a given side of the axis;

(d) restricting for air flow a part of said compartment discharge face half portion located closer to the axis, wherein restricting said compartment discharge face comprises mounting an extender dish centrally on and flaring away from said compartment discharge face, said extender dish having a central opening for passage of a fuel stream and surrounding air stream from a fuel nozzle and surrounding air passage, said extender dish having a narrow projection across said compartment half portion further from the axis and a wide projection across said compartment half portion closer to the axis;

wherein restricting said compartment discharge face comprises mounting an extender dish centrally on and flaring away from said compartment discharge face, said extender dish having a central opening for passage of a fuel stream and surrounding air stream from a fuel nozzle and surrounding air passage, said extender dish having a narrow projection across said compartment half portion further from the axis and a wide projection across said compartment half portion closer to the axis.

26. The method as in claim 25 wherein restricting said compartment discharge face further comprises mounting at least one plate partially extending across said compartment discharge face half portion closer to the axis.

* * * * *